US009562740B1

(12) United States Patent
Korliker et al.

(10) Patent No.: US 9,562,740 B1
(45) Date of Patent: Feb. 7, 2017

(54) ROTATING GUN STOCK

(71) Applicants: Eshai Korliker, Kiryat Shmoneh (IL); Tal Amlani, Kibbutz Shamir (IL); Ronnie Gilboa, Moshav Beit Hillel (IL)

(72) Inventors: Eshai Korliker, Kiryat Shmoneh (IL); Tal Amlani, Kibbutz Shamir (IL); Ronnie Gilboa, Moshav Beit Hillel (IL)

( * ) Notice: Subject to any disclaimer, the term of this patent is extended or adjusted under 35 U.S.C. 154(b) by 0 days.

(21) Appl. No.: 15/248,021

(22) Filed: Aug. 26, 2016

Related U.S. Application Data

(60) Provisional application No. 62/250,198, filed on Nov. 3, 2015.

(51) Int. Cl.
*F41C 23/14* (2006.01)
*F41C 23/20* (2006.01)

(52) U.S. Cl.
CPC ..... *F41C 23/14* (2013.01); *F41C 23/20* (2013.01)

(58) Field of Classification Search
CPC ..... F41C 23/04; F41C 23/12; F41C 23/14; F41C 23/20
USPC ..... 42/71.01, 72, 73, 75.03; 89/158
See application file for complete search history.

(56) References Cited

U.S. PATENT DOCUMENTS 2,066,218 A * 12/1936 Morgan ..... F41C 23/14 42/73
5,009,021 A * 4/1991 Nelson ..... F41C 23/20 42/73
7,762,018 B1 7/2010 Fitzpatrick et al.
8,720,099 B1 5/2014 Sisk
9,395,149 B2 * 7/2016 Balgaard ..... F41C 23/08
2005/0268516 A1 * 12/2005 Nelson ..... F41G 1/00 42/73
2007/0214697 A1 * 9/2007 Ochoa ..... F41C 23/14 42/73
2014/0109453 A1 * 4/2014 Paquette ..... F41C 23/14 42/73
2016/0061559 A1 * 3/2016 Wood ..... F41C 23/14 42/73

* cited by examiner

*Primary Examiner* — John D Cooper
(74) *Attorney, Agent, or Firm* — 1st-Tech-Ideas: Haim M. Factor

(57) ABSTRACT

A rotating gun stock for a firearm having a gun stock fore-end, the rotating gun stock comprising: a rotary positioning disc fixed within the fore-end, the fore-end having a distal end, a proximal end, and a longitudinal axis, the rotary disc fixed within the fore-end substantially at the distal end; the rotary disc further having a first and a second face and a center coaxial with the longitudinal axis, the first face directed towards the proximal end and the second face having a plurality of concentric accepting slots and a radial slot formed therein, the radial slot formed to communicate perpendicularly with the plurality of accepting slots; a butt positioned substantially perpendicularly to the fore-end at the distal end, the butt rotatably attached to the center of the rotary positioning disc, the butt constrained to rotate only about the longitudinal axis; a selector inserted within a selector slot in the butt, the selector protruding into the radial slot and thereby successively into the plurality of accepting slots; wherein rotation of the butt is configured to be selected by the selector to enable a plurality of butt rotational positions about the longitudinal axis, including a lock position of zero degrees.

16 Claims, 6 Drawing Sheets

Section B - B

PRIOR ART
Detail "A"

Section B - B

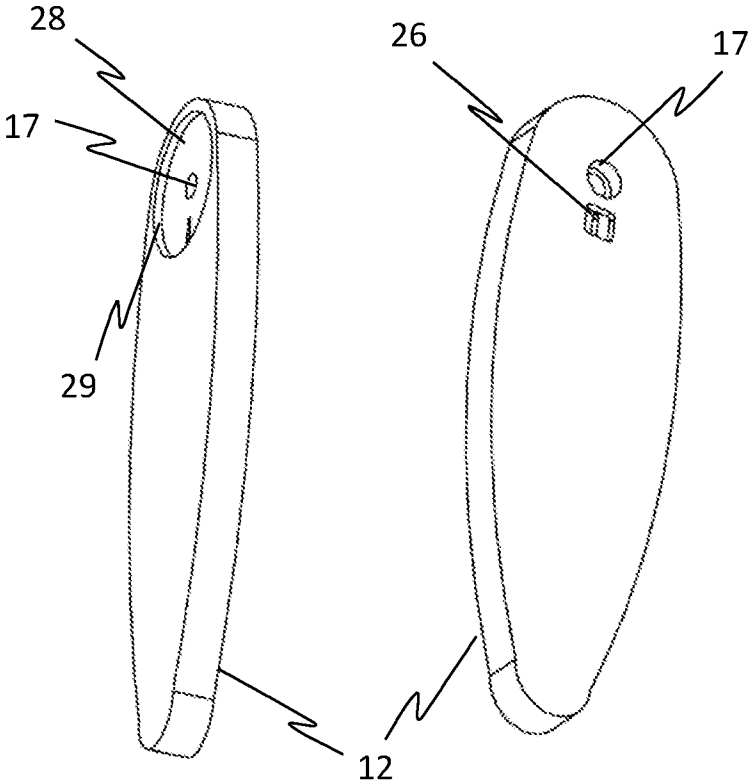
FIG 6B
FIG 6A
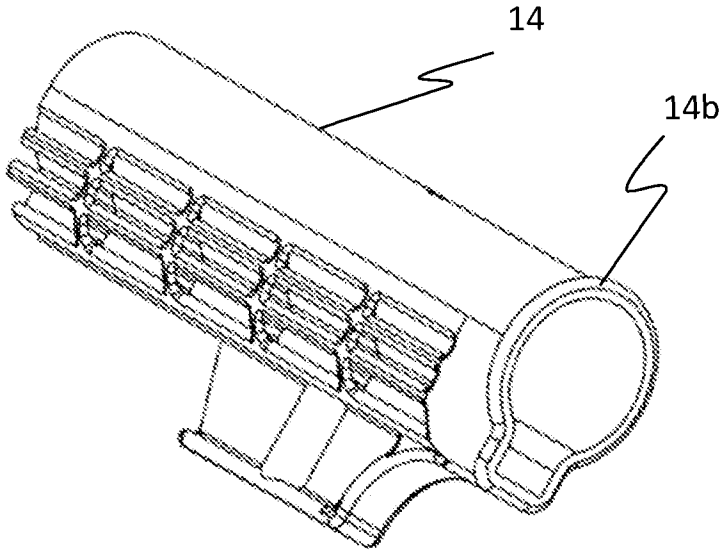
FIG 5

ROTATING GUN STOCK

The present application claims priority from U.S. Provisional Application No. 62/250,198, filed 3 Nov. 2015, whose disclosure is incorporated herein by reference.

FIELD OF THE INVENTION AND BACKGROUND

The current invention relates to firearms in general, and specifically to a rotating gun stock suitable for an array of firearms.

In the specification and claim which follow hereinbelow, the term "stock" as used in "gunstock" and/or "gun stock" is intended to have equivalent meaning to "butt", as "gun butt" or "butt stock". Additionally, as is clarified hereinbelow, embodiments of the current invention are not limited to a gun stock suitable for a rifle (i.e. assault or hunting rifle, inter alia) but to other firearm configurations, such as a hand gun, inter alia.

Gun and rifle stocks are manufactured to fit the average right-handed shooter—whereas specialized stocks can be manufactured to fit the exact requirements/anatomy of the shooter. There are a number of variables such as: head position; eye-sighting; recoil pad; inter alia, that are taken into consideration to make a suitable fit of the gun stock, and which can change the dynamics of the firearm.

Prior art which addresses his issue includes, inter alia:

U.S. Pat. No. 8,720,099, whose disclosure is incorporated herein by reference, in which Sisk describes a multi-axis adjustable buttstock that incorporates a buttstock, having, a grip neck, and a butt along with an interfaced set of two serrated grip retainers attached onto the buttstock grip neck, for buttstock tilt adjustment. A plurality of selectable flat and tapered grip spacers engage the grip serrated retainers for trigger grip length, cast and drop adjustment of the buttstock. A flanged stock bolt is disposed through a portion of the buttstock retaining the spacers and grip retainers while being embraced tightly by a first lock ring. A threaded rod is inserted into the buttstock a desired distance for length of pull adjustment and a second threaded lock ring is positioned on the threaded rod for securement. A recoil pad adapter plate, having a plurality of concentric holes, is attached to the threaded rod, for recoil pad slant adjustment, and a recoil pad is attached to the adapter plate aligned with selected recoil pad holes for recoil pad height and angle adjustments.

Fitzpatrick et al., in U.S. Pat. No. 7,762,018, whose disclosure is incorporated herein by reference, describe a modular gunstock utilizing a two-piece mounting structure and a stock module. The structure comprises a weapon attachment, in the case of an AR15/M16 rifle a receiver extension tube, and a sleeve slidable over the attachment and containing mounting structure for the stock module. The stock module is adjustable for length and features a length pre-set system, a latch with independent dual-pawls and an integrated impact buffer, modular tailpiece, and storage. The sleeve also features a position selectable fixed cheek plate.

Prior art rotating gun stock solutions however have shortcomings including, but not limited to: incompatibility with protective vests worn when firing; difficulty in switching stock positions easily; difficulty in assembly and disassembly of the gun stock; gun stock suited only to right-handed or only left-handed firer (and not both); incompatibility across an array of firearms, including handguns; and overall difficulty and/or limitations to adjust/operate.

There is therefore a need to provide an adjustable gun stock which can be readily adapted to a wide variety of firearms and which may be adjustable in the field using adjustments on the gun stock itself, without specialized tools—among other improvements.

SUMMARY OF INVENTION

According to the teachings of the current invention, there is provided a rotating gun stock for a firearm having a gun stock fore-end, the rotating gun stock comprising: a rotary positioning disc fixed within the fore-end, the fore-end having a distal end, a proximal end, and a longitudinal axis, the rotary disc fixed within the fore-end substantially at the distal end; the rotary disc further having a first and a second face and a center coaxial with the longitudinal axis, the first face directed towards the proximal end and the second face having a plurality of concentric accepting slots and a radial slot formed therein, the radial slot formed to communicate perpendicularly with the plurality of accepting slots; a butt positioned substantially perpendicularly to the fore-end at the distal end, the butt rotatably attached to the center of the rotary positioning disc, the butt constrained to rotate only about the longitudinal axis; a selector inserted within a selector slot in the butt, the selector protruding into the radial slot and thereby successively into the plurality of accepting slots; wherein rotation of the butt is configured to be selected by the selector to enable a plurality of butt rotational positions about the longitudinal axis, including a lock position of zero degrees. Preferably the selector includes a supporting base retained within the selector slot in the butt, and an extended selector piece, the extended selector piece protruding into the radial slot and thereby into at least one of the plurality of accepting slots. Most preferably the selector is configured to translate towards or away the center but not to translate in the direction parallel to the longitudinal axis. Typically, the plurality of accepting slots are formed to correspond to respective rotational positions about the longitudinal axis. Most typically, the respective rotational positions include at least one chosen from the list including: zero degrees; 90 degrees; −90 degrees; and 180 degrees. Preferably, each of the plurality of accepting slots has a spring positioned therein, the spring configured to bias the butt back to the zero degree position when the butt is released. Most preferably, the firearm includes at least one chosen from the list including: an AK47; an AR15; an M16; and a hand gun. Typically, the rotating gun stock is configured to be retrofitted to the firearm.

According to the teachings of the current invention, there is further provided a method of operating a rotating gun stock for a firearm having a gun stock fore-end, and comprising the steps of: taking a rotary positioning disc fixed within the fore-end, the fore-end having a distal end, a proximal end, and a longitudinal axis, the rotary disc fixed within the fore-end substantially at the distal end; forming the rotary disc, further having a first and a second face and a center coaxial with the longitudinal axis, the second face having a plurality of concentric accepting slots and a radial slot formed therein, directing the first face towards the proximal end, and forming the radial slot to communicate perpendicularly with the plurality of accepting slots; positioning a butt substantially perpendicularly to the fore-end at the distal end, rotatably attaching the butt to the center of the rotary positioning disc with the butt only able to rotate about the longitudinal axis; inserting a selector within a selector slot in the butt, the selector protruding into the radial slot and thereby successively into the plurality of accepting slots;

whereby rotation of the butt is selected by the selector to enable a plurality of butt rotational positions about the longitudinal axis, including a lock position of zero degrees. Preferably, the selector includes a supporting base retained within the selector slot in the butt, and an extended selector piece, the extended selector piece protruding into the radial slot and thereby into the plurality of accepting slots. Most preferably, the selector translates towards or away the center but does not translate in the direction parallel to the longitudinal axis. Typically, the plurality of accepting slots correspond to respective rotational positions about the longitudinal axis. Most typically, the respective rotational positions include at least one chosen from the list including: zero degrees; 90 degrees; −90 degrees; and 180 degrees. Preferably, a spring is positioned within each of the plurality of accepting slots, the spring serving to bias the butt back to the zero degree position when the butt is released. Most preferably, the firearm includes at least one chosen from the list including: an AK47; an AR15; an M16; and a hand gun. Typically, the rotating gun stock is retrofitted to the firearm.

LIST OF FIGURES

The invention is herein described, by way of example only, with reference to the accompanying drawings, wherein:

FIG. 5 is an isometric view of gun stock fore-end, in accordance with embodiments of the current invention;

FIGS. 6A and 6B are isometric views of the butt, in accordance with embodiments of the current invention.

DETAILED DESCRIPTION

Embodiments of the present invention relate to firearms in general, and specifically to a rotating gun stock suitable for an array of firearms.

Figure 1:
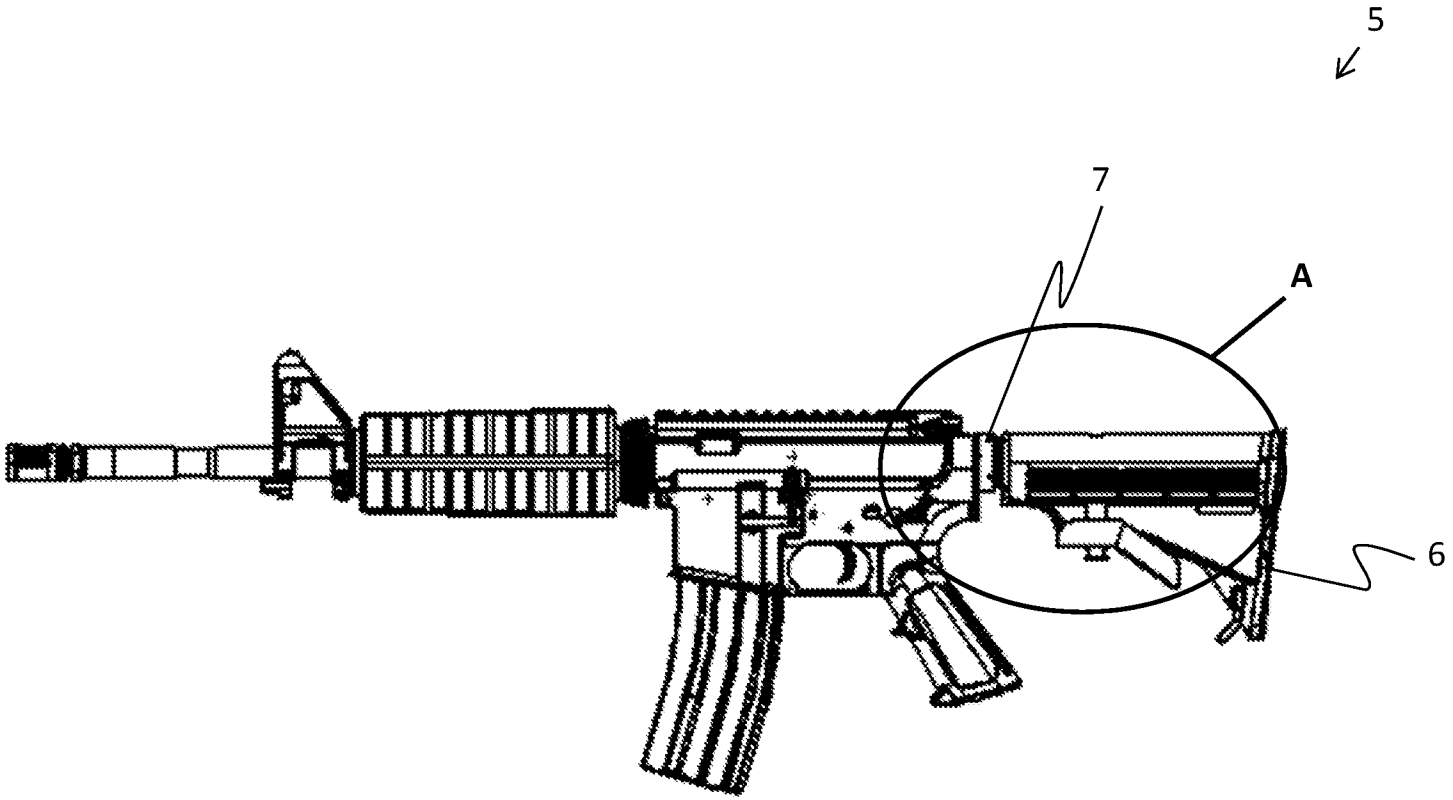
PRIOR ART FIG 1
FIG. 1 is a pictorial representation of a prior art firearm, including a firearm butt stock and a butt stock attachment point.

Reference is currently made to FIG. 1, which is a pictorial representation of a prior art firearm 5, including a firearm butt stock 6 and a buffer tube locking nut 7. Additionally, reference is presently made to FIG. 2, which is a detailed view of buffer tube locking nut 7 of prior art firearm 5, shown in FIG. 1, and a prior art buffer tube 8. Buffer tube 8 is mechanically connected to firearm 5, as known in the art, and has an elongated generally cylindrical/key-hole profile shape as shown in the figure, a buffer tube proximal end 8*a* and a buffer tube distal end 8*b*.

Prior art firearm 5 may include exemplary weapons such as, but not limited to: AK47; AR15; and M16; as well as hand guns. Firearm butt stock 6 represents a number of optional and variably-shaped butt stocks that generally may be interchanged by attaching other parts (not shown in the current figure) and the butt stock to stock attachment point 7 and/or to buffer tube 8, as known in the art and as described further hereinbelow.

Figure 3:
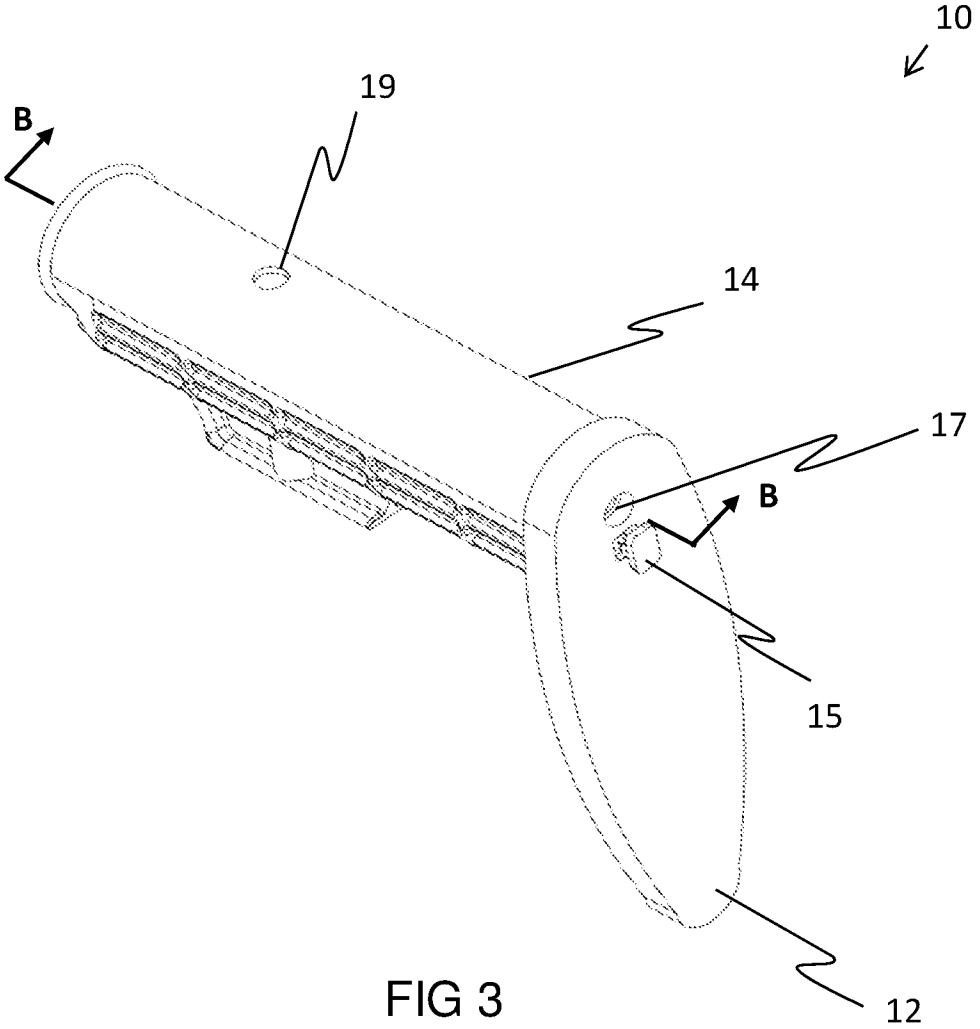
FIG. 3 is an isometric view of a rotating gun stock, in accordance with embodiments of the current invention.
Figure 4:
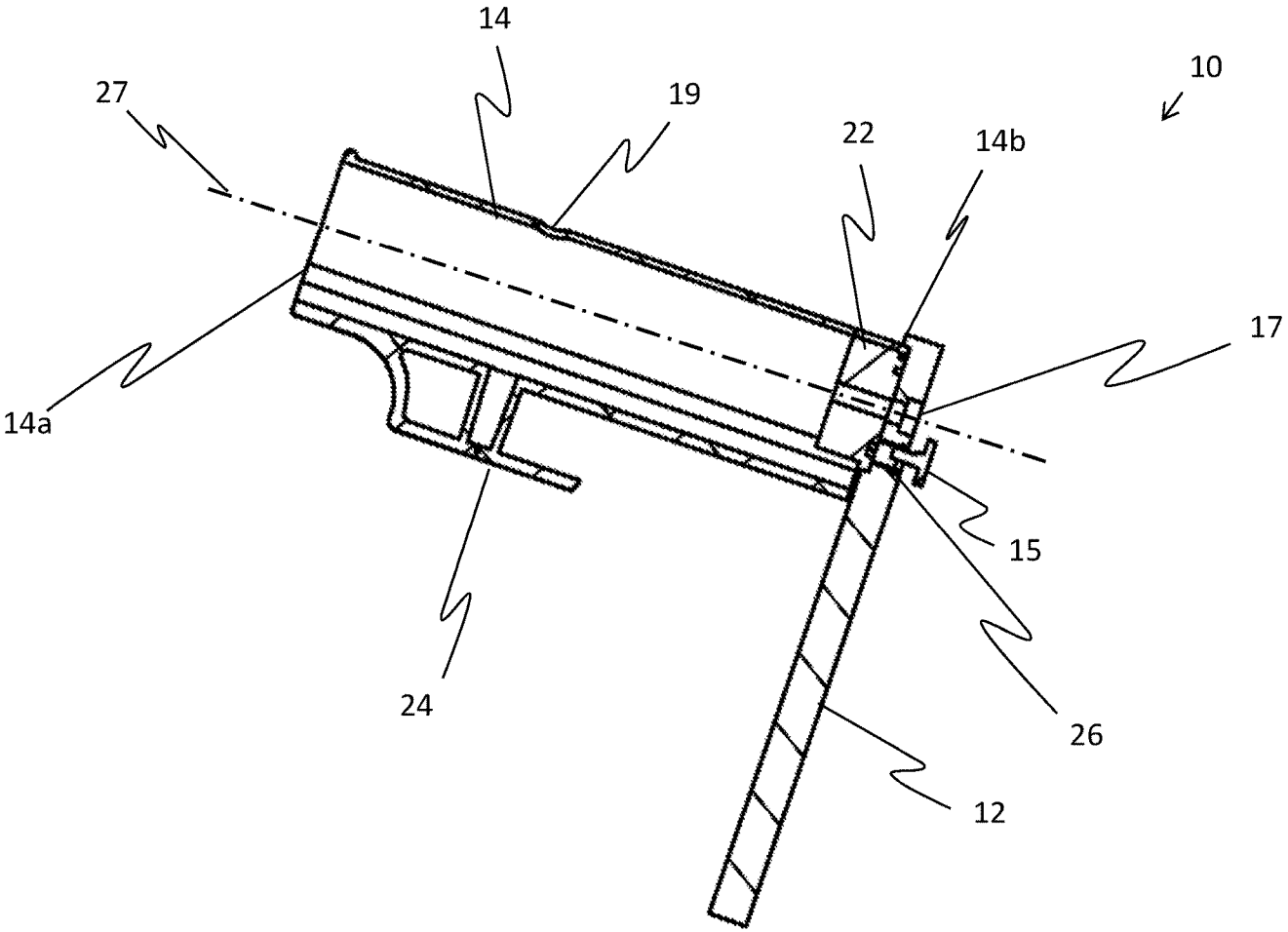
FIG. 4 is a sectional side view of the rotating gun stock shown in FIG. 3, in accordance with embodiments of the current invention.

Reference is currently made to FIGS. 3 and 4, which are an isometric view and a sectional view, respectively, of a rotating gun stock 10, in accordance with embodiments of the current invention. Rotating gun stock 10 includes: a butt 12; an exemplary gun stock fore-end 14; a selector 15; an attachment pin hole 17; a service hole 19; a rotary positioning disc 22; a locking pin 24; and a selector slot 26.

Exemplary gun stock fore-end 14 is typically attached to buffer tube 8 (ref FIG. 2) with a click-action, afforded by locking pin 24, as known in the art. Exemplary gun stock fore-end 14 has a fore-end proximal end 14*a* and a fore-end distal end 14*b*, and a longitudinal axis 27, all as shown in the figure—and as known in the art. In an embodiment of the current invention rotary positioning disc 22 has a generally truncated cylindrical-like shape and is described further hereinbelow. The rotary positioning disc is shaped to be positioned snuggly within gun stock fore-end 14. Rotary positioning disc 22 is mechanically constrained within gun stock fore-end 14 and extending only partly at fore-end distal end 14*b*, as further described hereinbelow. The mechanical constraint of rotary positioning disc 22 may include, but is not limited to: a strong adhesive and a mechanical connector (not shown in the figure).

Butt 12 is shown in FIGS. 3 and 4 having a conventional orientation (meaning an orientation of butt 12 substantially parallel to that of a magazine of prior art weapon 5, such as shown in FIG. 1) as in common in most conventional gun stocks. However, embodiments of the current invention include rotated orientations of butt 12 about longitudinal axis 27, as described hereinbelow. Butt 12 is positioned substantially perpendicularly to gun stock fore-end 14 at distal end 14*b* and is attached to the gun stock fore-end by two mechanisms which afford constrained longitudinal movement and allow rotary movement of butt 12 with regard to stock for-end 14 about longitudinal axis 27, including:

- selector 15 (further described hereinbelow) being inserted within selector slot 26 and part of selector 15 protruding within a plurality of accepting slots (not shown in the current figure, but shown in a later figure) in rotary positioning disc 22; and
- an attachment pin (not shown in the figure) being inserted through attachment pin hole 17 and the attachment pin then being mechanically connected to rotary positioning disc 22, constraining longitudinal movement of butt 12 but allowing rotational movement of butt 12 about longitudinal axis 27.

The constrained longitudinal and rotary movement of butt 12 with regard to stock for-end 14 is described further hereinbelow.

Figure 2:
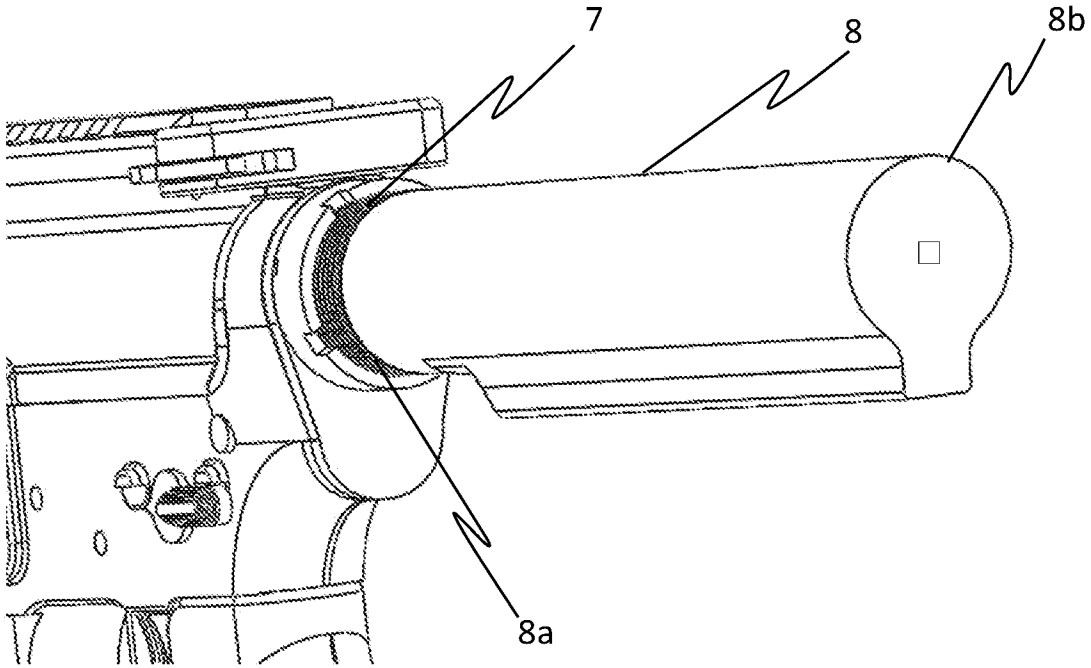
FIG. 2 is a detailed view of the butt stock and an attachment point of the prior art firearm shown in FIG. 1 and showing a buffer tube, in accordance with embodiments of the current invention.

Fore-end 14 is fabricated to snuggly fit onto buffer tube 8, which is shown in FIG. 2 and the fore-end is locked into place onto buffer tube by means of locking pin 24, as known in the art. As such, fore-end 14 and the rotating gun stock may be retrofitted onto a weapon, or fore-end 14 and the rotating gun stock may be provided with an originally-manufactured weapon, such as, but not limited to the weapons mentioned hereinabove.

Reference is currently made to FIGS. 5, 6A and 6B, which are an isometric view of gun stock fore-end 14 (as shown in FIGS. 3 and 4) and isometric views of two sides of the butt (as shown in FIGS. 3 and 4), respectively, in accordance with embodiments of the current invention. Apart from differences described below, gun stock fore-end 14 and butt 12 are identical in notation, configuration, and functionality to that shown previously in FIGS. 3 and 4, and elements indicated by the same reference numerals and/or letters are generally identical in configuration, operation, and functionality as described hereinabove. In one embodiment of the current invention, gun stock fore-end 14 is a typical prior-art component, to which butt 12, inter alia, are connected to.

In FIG. 5, gun stock is shown without rotary positioning disc 22 in position for clarity—however the following discussion is to be understood with rotary positioning disc 22 being configured within gun stock fore-end 14 as described hereinabove. As noted hereinabove, butt 12 is positioned substantially perpendicularly to gun stock fore-end 14 at distal end 14*b*. Butt 12 has a circularly-shaped indentation 28 formed substantially concentrically about attachment pin hole 17, as shown in FIG. 6A. Circularly-shaped indentation 28 has a characteristic depth 29 on the order of a few millimeters and a characteristic diameter (not indicated in the figure) to allow the butt to be mated on the positioning disc and to rotate freely. Rotary positioning disc 22 protrudes from distal end 14*b* of gun stock fore-end 14 so that the protruding part of the disc mates with circularly-shaped indentation 28, and so that butt 12 is positioned substantially flush with distal 14*b*, but may rotate freely at the distal end 14*b*. The structure of rotary positioning disc 22 and how it is positioned in gun stock fore-end 14 is further described hereinbelow.

Reference is currently made to FIGS. 7A, 7B and 8A, 8B, which are isometric views of rotary positioning disc 22 and of selector 15 shown in FIGS. 3 and 4, respectively, in accordance with embodiments of the current invention. Apart from differences described below, rotary positioning disc 22 and selector 15 are identical in notation, configuration, and functionality to that shown in FIGS. 3 and 4, and elements indicated by the same reference numerals and/or letters are generally identical in configuration, operation, and functionality as described hereinabove.

Rotary positioning disc 22 has two faces: a proximal face 22*a*; and a distal face 22*b*. Rotary positioning disc 22 further has a structure which includes a disc attachment pin hole 30, a gun stock fore-end insertion neck 34 and a butt insertion end 32. The fore-end insertion neck 34 is substantially positioned within gun stock fore-end 14, towards proximal end 14*a*—as described herein above. Butt insertion end 32 has a slightly larger diameter than that of the gun stock for-end insertion neck and is substantially mated within circularly-shaped indentation 28—as described hereinabove.

In one embodiment of the current invention, fore-end insertion neck 34 may have a key-hole shape (not shown in the figures) similar to the shape of gun stock fore-end 14—however the circular shape of butt insertion end 32 is maintained in this configuration.

Disc attachment pin hole 30 is configured to be aligned substantially concentrically with pin hole 17 (of butt 12) along axis 27—refer to FIGS. 3 and 4. When butt 12 is mounted upon positioning disc 22, a pin (not shown in the figure) is inserted through pin hole 17 and into pin hole 30. The pin is mechanically constrained to rotary positioning disc 22, thereby constraining butt 12 in a longitudinal direction. Furthermore, because butt insertion end is mated within circularly-shaped indentation 28, as described hereinabove, butt 12 is further radially constrained and may only rotate about axis 27.

Figure 7A:
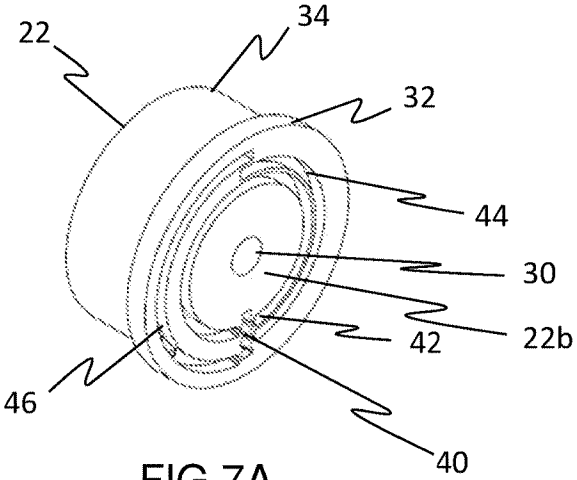
Figure 7B:
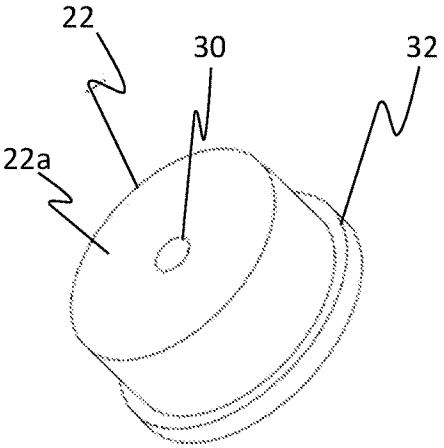

As shown in FIG. 7A, rotary positioning disc 22 further has a structure which includes: a radial slot 40 and three substantially concentric accepting slots 42, 44, and 46, also herein called "first slot", "second slot", and "third slot", respectively—all formed in distal face 22*b*. The three slots are all configured substantially concentrically to pin hole 30 (which, when rotary positioning disc 22 is positioned within gun stock fore-end 14, rotary positioning disc 22 is positioned substantially coaxially with axis 27). Radial slot 40 is likewise configured substantially radially to pin hole 30 and axis 27. Radial slot 40 is formed to communicate perpendicularly with the three accepting slots. The radial slot extends towards pin hole 30, past the third slot. Rotary positioning disc 22 is fixed in place within gun stock fore-end 14 so that radial slot 40 is aligned in a "conventional" butt alignment position (such as that shown in FIG. 3), meaning substantially parallel to the direction of a magazine of prior art weapon 5 (shown in FIG. 1). Radial slot 40 thereby defines a "zero degree" rotational position, as described hereinbelow.

Radial slot 40 is formed to receive extended selector piece 54 of selector 15, when the selector is positioned in place, as shown in FIGS. 3 and 4 and as described hereinbelow. The length of radial slot 40 and its communication with the three slots serve to define four selecting positions of the selector—namely: a locked position, and a third slot, a second slot, and a first slot position—all as further described below.

Figure 8A:
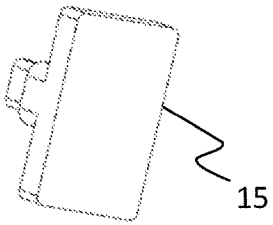
FIGS. 7A, 7B and 8A, 8B are isometric views of the positioning disc and of the selector, respectively, in accordance with embodiments of the current invention.
Figure 8B:
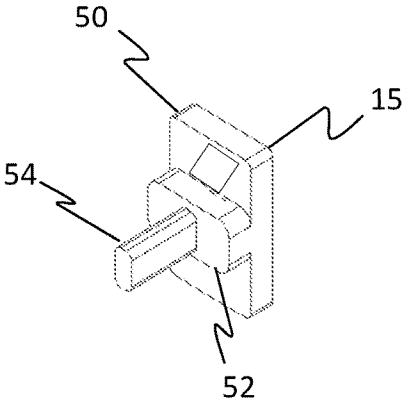

Selector 15 is formed having a thickness 50, a supporting base 52, and an extended selector piece 54—as shown in FIG. 8A.

With butt 12 positioned onto gun stock fore-end 14, as shown in FIG. 3, and as described hereinabove, selector 15 is inserted into selector slot 26 so that extended selector piece 54 passes through selector slot 26 and protrudes into radial slot 40. Selector 15 is formed and configured so that it may only translate towards or away from pin hole 17 (i.e. substantially radially to axis 27)—but cannot translate in the direction parallel to axis 27. Selector 15 (with selector piece 54 inserted in position within radial slot) may be moved to select the four selecting positions noted hereinabove—namely: locked; third slot; second slot; and first slot.

Slots 42, 44, and 46 in positioning disc respectively are formed to allow rotation of butt 12 in three corresponding rotational directions, measured from the "zero rotation" position namely: to the left approximately 180 degrees; to the left approximately 90 degrees; and to the right approximately 90 degrees. It is seen in FIG. 7A that the respective 3 slots are formed with each having a slot displacement/length in excess of the respective rotation afforded to butt 12. Each slot has a spring (not shown in the figures) positioned within the respective slot, the spring serving to bias the selector back to the zero rotation position, i.e. back to the radial slot. The spring occupies part of the respective slot displacement/length so that net rotational displacement of each slot represents that of the values noted hereinabove.

Radial slot 40 is formed with springs and/or bearing arrangements to enable a "click-in-place" translational movement, as known in the art, of selector 15 to the four positions noted hereinabove. Selector 15 may be easily and accurately translated from one position to the next typically by a push or pull of a finger or a thumb resting on butt 12 at selector 15. In this way, butt rotation may be rapidly and securely selected to enable each of the rotational positions noted above-including the lock position noted above. Furthermore, and as noted hereinabove, when no opposing rotational force is present, butt 12 assumes a normal "zero position" due to the spring-bias of respective slots.

Respective springs of respective slots are chosen to have a force to allow the butt to be maintained in a selected rotational orientation when the butt is held in that position and/or when the butt is pressed against a firer's shoulder (not shown in the figures).

Although rotary positioning disc 22 described hereinabove is described and shown with three slots, yielding four selector positions (including the lock position), it may be understood that embodiments of the current invention can include less or more slots in positioning disc 22 and less or more corresponding selector positions.

Other advantages/functions of embodiments of the current invention include:

- The shape and orientaion of the rotating gun stock is suitable for use with all ceramic battle vests and currently-available light and heavy body armor;
- Retrofitting and dissasembly of the rotating gun stock is straightforward and covenient—especially when the gun stock fore-end is fitted in advance with the rotating gun stock, the entire assembly gun stock for-end and rotating gun stock may be retrofitted into place onto the weapon by a quick click-action—as know in the art;
- Rotation of the rotating gun stock to either side (right or left) of a conventional butt orientation allows for easier magazine exchange and for dealing with firearm jams, without the need to bring the firearm down from the shoulder—saving valuable time in combat and/or operational situations;
- Right or left rotation is afforded for a left-handed or right-handed weapon firer;
- When the rotating gun stock is released from the firer's shoulder, the gun stock rotates back to the conventional orientation (ie that shown in FIGS. 1, 3, and 4);
- No tools are needed to retrofit/remove/operate the rotating gun stock;
- The rotating gun stock is compatiable with all firearms including handguns, assault, and hunting rifles;

It will be appreciated that the above descriptions are intended only to serve as examples, and that many other embodiments are possible within the scope of the present invention as defined in the appended claims.

The invention claimed is:

1. A rotating gun stock for a firearm having a gun stock fore-end, the rotating gun stock comprising:

a rotary positioning disc fixed within the fore-end, the fore-end having a distal end, a proximal end, and a longitudinal axis, the rotary disc fixed within the fore-end substantially at the distal end;

the rotary disc further having a first and a second face and a center coaxial with the longitudinal axis, the first face directed towards the proximal end and the second face having a plurality of concentric accepting slots and a radial slot formed therein, the radial slot formed to communicate perpendicularly with the plurality of accepting slots;

a butt positioned substantially perpendicularly to the fore-end at the distal end, the butt rotatably attached to the center of the rotary positioning disc, the butt constrained to rotate only about the longitudinal axis;

a selector inserted within a selector slot in the butt, the selector protruding into the radial slot and thereby successively into at least one of the plurality of accepting slots;

wherein rotation of the butt is configured to be selected by the selector to enable a plurality of butt rotational positions about the longitudinal axis, including a lock position of zero degrees.

2. The rotating gun stock of claim 1, wherein the selector includes a supporting base retained within the selector slot in the butt, and an extended selector piece, the extended selector piece protruding into the radial slot and thereby into at least one of the plurality of accepting slots.

3. The rotating gun stock of claim 2, wherein the selector is configured to translate towards or away from the center but not to translate in the direction parallel to the longitudinal axis.

4. The rotating gun stock of claim 3, wherein the plurality of accepting slots are formed to correspond to respective rotational positions about the longitudinal axis.

5. The rotating gun stock of claim 4, wherein the respective rotational positions include at least one chosen from the list including: zero degrees; 90 degrees; −90 degrees; and 180 degrees.

6. The rotating gun stock of claim 5, wherein each of the plurality of accepting slots has a spring positioned therein, the spring configured to bias the butt back to the zero degree position when the butt is released.

7. The rotating gun stock of claim 1, wherein the firearm includes at least one chosen from the list including: an AK47; an AR15; an M16; and a hand gun.

8. The rotating gun stock of claim 7, wherein the rotating gun stock is configured to be retrofitted to the firearm.

9. A method of operating a rotating gun stock for a firearm having a gun stock fore-end, and comprising the steps of:

taking a rotary positioning disc fixed within the fore-end, the fore-end having a distal end, a proximal end, and a longitudinal axis, the rotary disc fixed within the fore-end substantially at the distal end;

forming the rotary disc, further having a first and a second face and a center coaxial with the longitudinal axis, the second face having a plurality of concentric accepting slots and a radial slot formed therein, directing the first face towards the proximal end, and forming the radial slot to communicate perpendicularly with the plurality of accepting slots;

positioning a butt substantially perpendicularly to the fore-end at the distal end, rotatably attaching the butt to the center of the rotary positioning disc with the butt only able to rotate about the longitudinal axis;

inserting a selector within a selector slot in the butt, the selector protruding into the radial slot and thereby successively into at least one of the plurality of accepting slots;

whereby rotation of the butt is selected by the selector to enable a plurality of butt rotational positions about the longitudinal axis, including a lock position of zero degrees.

10. The method of claim 9, whereby the selector includes a supporting base retained within the selector slot in the butt, and an extended selector piece, the extended selector piece protruding into the radial slot and thereby into the plurality of accepting slots.

11. The rotating gun stock of claim 10, whereby the selector translates towards or away from the center but does not translate in the direction parallel to the longitudinal axis.

12. The rotating gun stock of claim 11, whereby the plurality of accepting slots correspond to respective rotational positions about the longitudinal axis.

13. The rotating gun stock of claim 12, whereby the respective rotational positions include at least one chosen from the list including: zero degrees; 90 degrees; −90 degrees; and 180 degrees.

14. The rotating gun stock of claim 13, whereby a spring is positioned within each of the plurality of accepting slots, the spring serving to bias the butt back to the zero degree position when the butt is released.

15. The rotating gun stock of claim 9, whereby the firearm includes at least one chosen from the list including: an AK47; an AR15; an M16; and a hand gun.

16. The rotating gun stock of claim 15, whereby the rotating gun stock is retrofitted to the firearm.

* * * * *